United States Patent [19]

LaSalle et al.

[11] Patent Number: 4,935,200

[45] Date of Patent: Jun. 19, 1990

[54] HIGH DENSITY, HIGH STRENGTH URANIUM-TITANIUM-HAFNIUM ALLOYS

[75] Inventors: Jerry C. LaSalle, Upper Montclair; Ravi Batra, Rockaway; Donald T. Rorabaugh, Budd Lake, all of N.J.

[73] Assignee: Allied-Signal Inc., Morris Township, Morris County, N.J.

[21] Appl. No.: 371,364

[22] Filed: Jun. 26, 1989

[51] Int. Cl.[5] ..... C22C 27/00

[52] U.S. Cl. ..... 420/3; 102/501; 102/517; 148/401

[58] Field of Search ..... 420/3; 148/401; 102/501, 517

[56] References Cited

U.S. PATENT DOCUMENTS

| | | | |
|---|---|---|---|
| 2,743,174 | 4/1956 | Keeler et al. | 420/3 |
| 2,990,274 | 6/1961 | Greenberg | 420/3 |
| 3,720,752 | 3/1973 | Van Houten | 420/3 |
| 3,969,160 | 7/1976 | Hemperly | 420/3 |

OTHER PUBLICATIONS

Phase Diagrams of Uranium Alloys, Ivanov et al.

National Materials Advisory Board Report NMA-B-350 (1980).

Eckelmeyer, "Diffusional Transformation, Strengthening Mechanisms, and Mechanical Properties of Uranium Alloys", Metallurgical Technology of Uranium and Alloys (1981), p. 129.

Eckelmeyer and Zanner, J., Nuc. Mat., 67, pp. 33–41, (1977).

*Primary Examiner*—Stephen J. Lechert, Jr.

*Attorney, Agent, or Firm*—Ernest D. Buff; Gerhard H. Fuchs

[57] ABSTRACT

A uranium-base alloy consists essentially of the formula $U_{bal}$-$Ti_x$-$Hf_y$, where "x" ranges from about 0.5 to 1.0 and "y" ranges from about 0.5 to 5.0. The alloy exhibits high strength, good ductility and high density and is especially suited for use in ballistic penetrator cores.

11 Claims, 5 Drawing Sheets

* 0.2% Offset

* 0.2% Offset

HIGH DENSITY, HIGH STRENGTH URANIUM-TITANIUM-HAFNIUM ALLOYS

The U.S. Government has rights in this invention pursuant to Contract Nos. DAAK10-84-0169 and DAAA21-88-C-0197 awarded by the Department of the Army.

BACKGROUND OF THE INVENTION

1. Field of Invention

This invention relates to high strength-high density uranium alloys; and more particularly to ingot cast uranium-titanium-hafnium ternary metal alloys having enhanced mechanical properties compared with uranium-titanium binary metal alloys.

2. Brief Description of the Prior Art

The need for high density ballistic alloys of improved strength and ductility has long been recognized. Uranium, with a density of 19.05 g/cm$^3$, is a well known candidate material for application in ballistic penetrator cores. Pure uranium, however, has a relatively low tensile strength (approximately 30 ksi). As a result, extensive efforts have been made to increase the tensile strength of uranium alloys while maintaining useful ductility. The results of these efforts culminated in the development of uranium-$\frac{3}{4}$Ti(wt %) alloy. Mechanical and ballistic properties of that alloy are described in the National Materials Advisory Board Report NMAB-350 (1980). This report, while recommending the use of U-$\frac{3}{4}$Ti for ballistic penetrator cores, also notes that improvement in mechanical properties must be made to address current and future counter threats in armor technology.

Typically, uranium-titanium metal alloys are cast into ingots and subsequently thermomechanically worked into plate or rod stock via techniques such as rolling or extrusion. As a final step, the alloys are given a high temperature anneal, typically at 800° C., causing the room temperature (orthorhombic) crystal structure of uranium to transform into the high temperature $\gamma$ (bcc) crystal structure. This transformation results in solutionization of the titanium into the uranium lattice. The alloys are then strongly quenched (at quenching rates greater than 100° C./sec) to room temperature, freezing the titanium into solution. Since titanium is not normally soluble in the room temperature alpha phase, a metastable martensitic variant, denoted $\alpha_a'$ is formed to accommodate the supersaturated titanium.

The strengthening mechanisms in uranium-titanium alloys have been summarized by Eckelmeyer in "Diffusional Transformation, Strengthening Mechanisms, and Mechanical Properties of Uranium Alloys", from Metallurgical Technology of Uranium and Uranium Alloys (1981), page 129. The strength of uranium-titanium is attributable to several components. Primary strengthening arises from solid solution strengthening resulting from titanium supersaturation in the martensite. This supersaturation is also the basis for a precipitation hardening mechanism, by way of which aging at temperatures at or near 350° C. causes formation of very fine precursors to the $U_2Ti$ phase. As aging time continues, the volume fraction of precipitates increases, causing the strength to improve and the ductility to decrease. Ultimately, a peak in the hardness occurs beyond which both strength and ductility decrease.

It has been well documented that both strength and ductility of uranium-titanium alloys is strongly dependent on the titanium concentration. Indeed, Koger and Hemperly, Y-DA-6665, Union Carbide Corp., Oak Ridge, Tenn., (1976) have demonstrated a threefold drop in tensile elongation as the titanium content was increased from 0.7 to 0.8(wt) %. Thus, a practical limit to strengthening by increasing titanium concentration is reached due to a rapid decay of tensile elongation, a measure of ductility.

SUMMARY OF THE INVENTION

The invention provides a high density-high strength uranium base alloy having, in combination, increased strength and tensile elongation as compared with U-$\frac{3}{4}$Ti. Such a combination of increased tensile strength and elongation is accomplished by applying conventional ingot processing techniques to uranium-titanium alloys that have been modified by addition of hafnium in the range of 0 to 2 (wt) %. Further increase in hafnium content (i.e. to 5 wt % Hf) show greater strength improvement, however, this level results in decreased tensile elongation.

Hafnium has a moderately high density (approximately 13.3 g/cm$^3$), with the result that the strength increase due the hafnium addition is obtained with minimal density loss. The ternary U-$\frac{3}{4}$Ti-1.0Hf alloy, for example, has a measured density of 18.3 g/cm$^3$ compared with 18.6 g/cm$^3$ for U-$\frac{3}{4}$Ti.

It is probable that the addition of hafnium to U-$\frac{3}{4}$Ti accomplishes the strength increase by the mechanism of solid solution strengthening. The retention of hafnium in the $\alpha_a'$ martensitic solid solution is, in part, due to the lack of a uranium-hafnium intermetallic. Titanium and zirconium, the two other Group IVB elements, form $U_2Ti$ and $U_2Zr$, respectively. The absence of a hafnium intermetallic thus allows more solute (i.e. hafnium) to be added without the excess precipitation of an intermetallic phase which could lower ductility.

This is important since Eckelmeyer and Zanner, J. of Nuc. Mat., 67, pp. 33–41, (1977) have demonstrated that excess $U_2Ti$ precipitation during the $\gamma$ quench is deleterious to ductility. The retention of hafnium supersaturation during the $\gamma$ quench is thus one of the factors responsible for the excellent tensile elongation.

The uranium-titanium-hafnium ternary alloys are also heat treatable in the same manner as the binary uranium-titanium alloys. In both cases, precipitation occurring in the supersaturated $\alpha_a'$ (martensite) results in an increase in hardness.

BRIEF DESCRIPTION OF THE DRAWINGS

The invention will be more fully understood and further advantages will become apparent when reference is made to the following detailed description of the preferred embodiment of the invention and the accompanying drawings, in which.

DESCRIPTION OF THE PREFERRED EMBODIMENTS

The invention provides a high strength uranium base alloy, consisting essentially of the formula $U_{bal}$-$Ti_x$ $Hf_y$ wherein x ranges from about 0.5 to 1.0 wt % and Y ranges from about 0.1 to 5.0 wt %.

The alloys are a ternary modification to the binary alloy system uranium-titanium in which the titanium is added to form a martensitic variant (denoted $\alpha_a'$) of the orthorhombic ($\gamma$) uranium lattice. The martensite is supersaturated with titanium forming a substitutional solid solution. As a solid solution, a substantial strength increase is obtained, as compared with unalloyed uranium. The supersaturation makes the alloy especially suited to undergo a precipitation hardening reaction. This reaction occurs in the range of about 200°–400° C.

Useful solid solution strengthening in uranium-titanium alloys is normally limited to having Ti content compositions ranging to 1.0 wt %, due to a strong decrease in ductility for alloys containing beyond approximately 0.8 wt % Ti. Alloys of the invention overcome this problem by the ternary addition of hafnium. The element hafnium forms no intermetallic phases with uranium and essentially extends the useful range over which the alloy can be subjected to solid solution strengthening without deleterious loss in ductility.

The improvement in 0.2% tensile yield strength resulting from the ternary hafnium addition is also seen in the 0.2% compressive yield strength. The ternary hafnium addition accomplishes this strengthening without detrimental reduction in density, due to hafnium's relatively high density of 13.3 g/cm$^3$. The combination of high strength, good ductility, and high density makes the $U_{bal}$-$Ti_x$-$Hf_y$ ternary alloys of the present invention ideal candidates for ballistic applications.

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1–4

Alloys of the invention having the compositions listed in Table I below were prepared using conventional ingot casting techniques. The alloys were melted under inert atmosphere at approximately 1300° C. and cast into billet form. Subsequently, the cooled billets were extruded at 600° C. into rod form.

TABLE I

| Sample No. | Alloy Composition (wt %) |
|---|---|
| 1 | U-3/4Ti-0.5Hf |
| 2 | U-3/4Ti-1.0Hf |
| 3 | U-3/4Ti-3.0Hf |

TABLE I-continued

| Sample No. | Alloy Composition (wt %) |
|---|---|
| 4 | U-3/4Ti-5.0Hf |

EXAMPLE 5

Figure 1A:
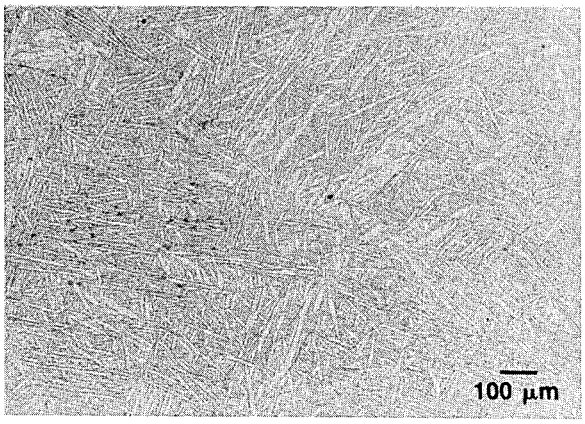
FIGS. 1*a* and 1*b* are optical micrographs of as-solutionized U-$\frac{3}{4}$Ti-1.0Hf and U-$\frac{3}{4}$Ti, respectively, the micrographs revealing an essentially identical microstructure consisting of lenticular martensite ($\alpha_a'$) with some decomposed $\alpha+U_2Ti$ (grey phase)
Figure 1B:
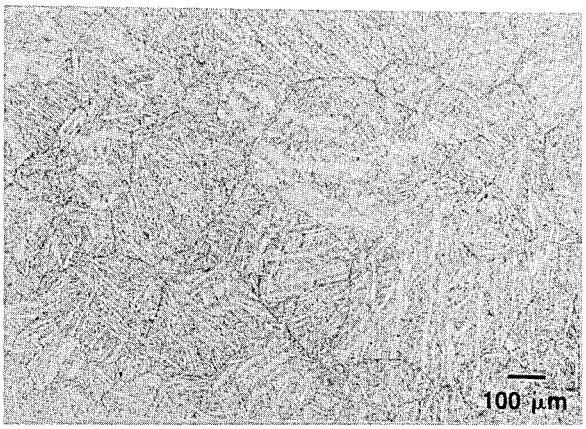

FIGS. 1a and 1b show optical micrographs of as-solutionized U-¾Ti-1.0Hf along side U-¾Ti, for reference. Both micrographs reveal an essentially identical microstructure of lenticular martensite ($\alpha_a'$) with some decomposed $\alpha+U_2Ti$ (grey phase). The presence of a substantially identical microstructure for the alloys when subjected to a given thermal treatment, indicates that the hafnium addition did not adversely affect the transformation behavior. From this it will be seen that the benefits of the ternary alloys may be realized without altering thermal processing history conventionally applied to the binary U-Ti alloys.

EXAMPLE 6

Alloys in Examples 1–4 were vacuum solutionized at 800° C. for 4 hrs and water quenched. The alloys were then machined into subscale tensile specimens with a 0.16 inch gauge diameter and 0.64 inch gauge length and tensile tested at room temperature. The results based on an average of three tensile tests, are listed in Table II. For comparison, the as-solutionized tensile data for U-¾Ti are listed. The effect of hafnium content on yield strength, ultimate tensile strength, and tensile elongation is further illustrated in FIGS. 2a, 2b, and 2c, which are plots of the data listed in Table II.

TABLE II

| Composition | 0.2% Yield Strength | Ultimate Tensile Strength | % Elongation to Fracture | % Reduction of Area |
|---|---|---|---|---|
| U-3/4Ti | 100 | 200 | 23 | 34 |
| U-3/4Ti-0.5Hf | 100 | 200 | 28 | 52 |
| U-3/4Ti-1.0Hf* | 134 | 235 | 20 | — |
| U-3/4Ti-3.0Hf | 146 | 247 | 13 | 25 |
| U-3/4Ti-5.0Hf | — | — | — | — |

*Rolled plate rather than extruded bar

Figure 2A:
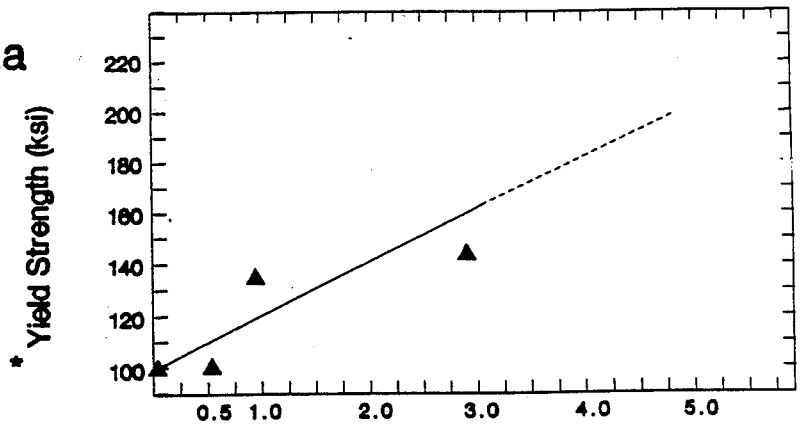
FIGS. 2*a*, 2*b*, and 2*c* are plots of the 0.2% yield strength, ultimate tensile strength, and tensile elongation of as-solutionized U-$\frac{3}{4}$Ti-Hf$_x$ ternary alloys as a function of hafnium content (in wt %), the alloys having been solutionized in vacuum at 800° C. for 4 hrs and water quenched.
Figure 2B:
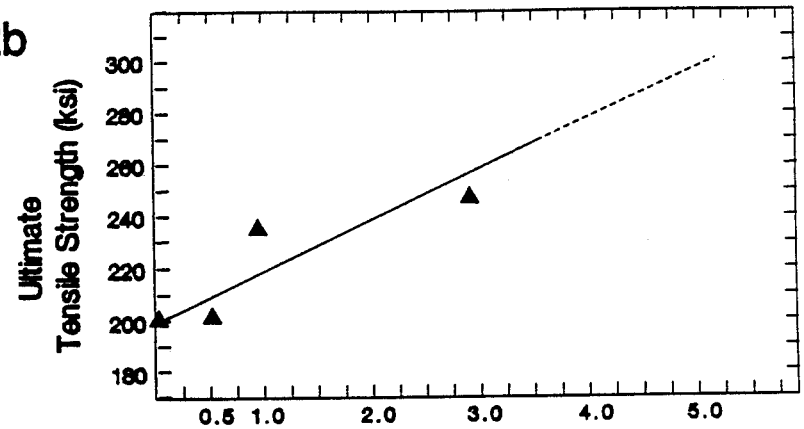
Figure 2C:
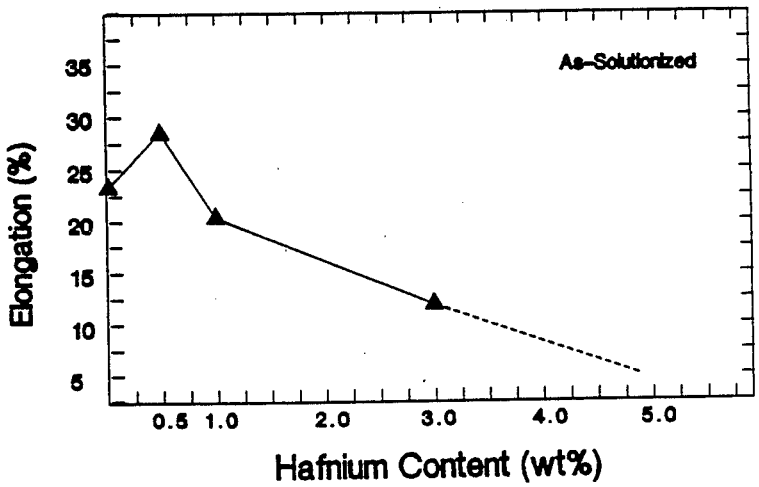

The tensile properties set forth in Table II and FIGS. 2a, 2b, and 2c show that the yield and ultimate strength increase with hafnium content. The tensile elongation, in contrast, appears to peak at 0.5% Hf. It is notable that the alloy U-¾Ti-0.5Hf shows improbed elongation and reduction of area while having the same strength as U-¾TI. The alloy U-¾Ti-1.0Hf shows improved strength over U-¾Ti while having approximately the same tensile elongation.

This example illustrates the importance of optimizing the amount of hafnium to provide increased strength while maintaining ductility. The presence of hafnium in the amounts called for by the present invention extends the amount of solid solution strengthening obtainable in this alloy without loss in ductility. Advantageously, hafnium additions allow the aggregate combination of tensile strength and tensile ductility to increase.

EXAMPLE 7

Figure 3:
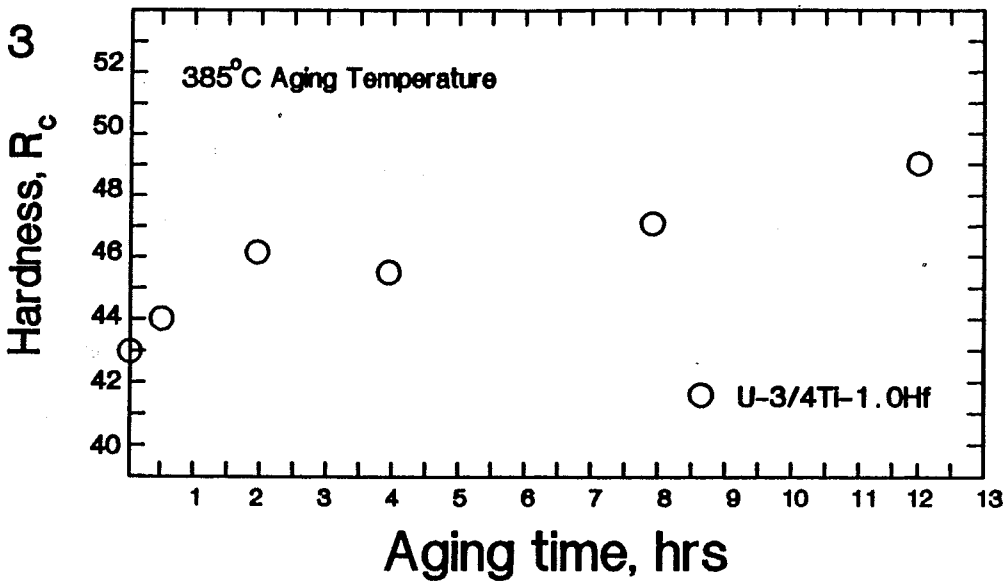
FIG. 3 is a graph showing hardness vs. aging time at 385° C., for one of the alloys shown in FIG. 2.
Figure 4A:
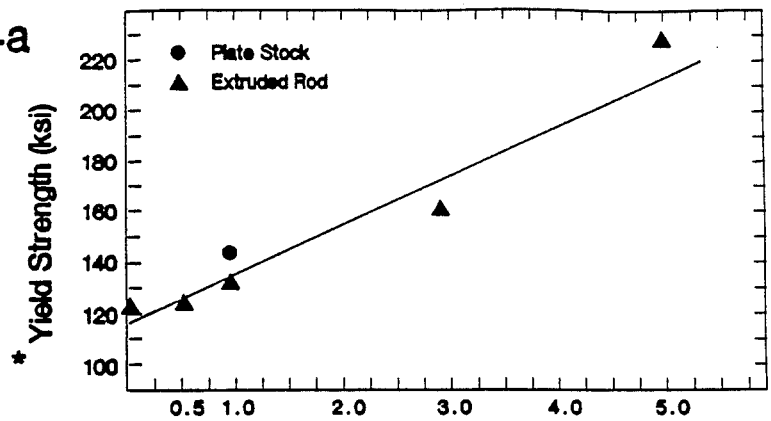
FIGS. 4a, 4b, and 4c are plots of the 0.2% yield strength, ultimate tensile strength, and tensile elongation for alloys of FIG. 2 that have when aged for 4 hrs at 385° C.
Figure 4B:
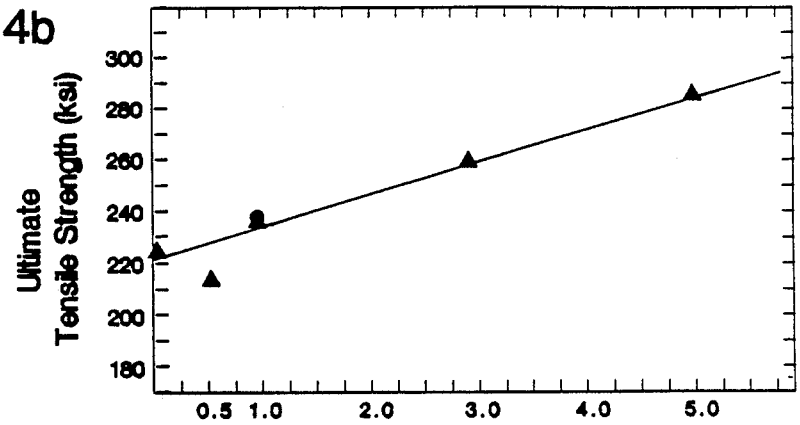
Figure 4C:
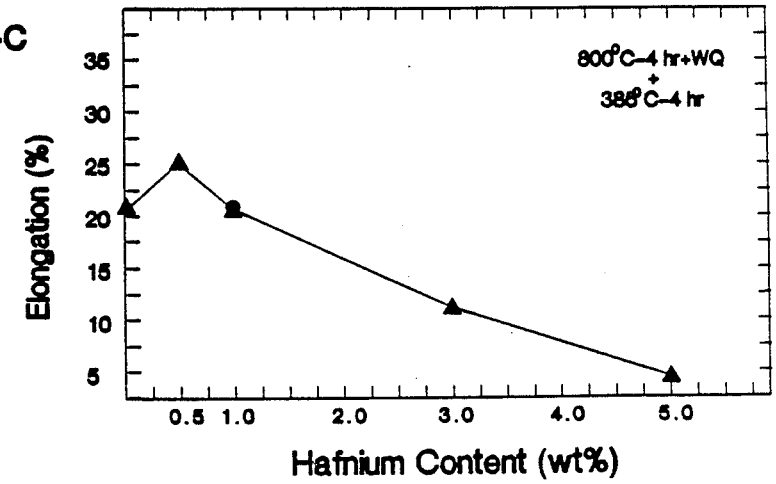

This example illustrates that the ternary U-¾Ti-Hf alloys are amenable to precipitation hardening in a manner similar to U-¾Ti. Hardness samples were prepared by solutionizing specimens in the manner described in Example 6. The samples were then aged for various times in a salt bath at 385° C. FIG. 3 plots the resulting hardness as a function of aging time. The U-¾Ti-1.0Hf alloy shows a hardening response, indicating that precipitation strengthening found in the binary U-Ti alloys is retained in the ternary U-Ti-Hf alloys.

EXAMPLE 8

The improved strength-ductility combination in the U-$Ti_xHf_y$ alloys, as compared with the binary U-Ti alloys, occurs not only in the as-Solutionized condition but also in the aged condition. This is illustrated by performing tensile tests in a manner identical to that of Example 5. In this example, however, an aging treatment of 385° C. for 4 hrs was added after the solutionization. The resulting data is listed in Table III, along with that of identically aged U-¾Ti for comparison.

The data reveal that the 385° C. aged ternary U-¾Ti-$Hf_y$ alloys show higher strength than U-¾Ti as was the case with the unaged material. Comparison of Table III and Table II also indicates that the aging caused an average 20 ksi yield strength improvement for any given composition. This further illustrates the precipitation hardening behavior shown by Example 7, i.e. that the strength of the ternary U-¾Ti-Hf alloys increases in a manner similar to U-¾Ti. The variation in tensile properties of the aged material as a function of hafnium content is further illustrated by FIGS. *4a*, *4b*, and *4c*. The behavior is similar to that observed in FIGS. *2a*, *2b*, and *2c*.

TABLE III

| Composition | 0.2% Yield Strength | Ultimate Tensile Strength | % Elongation to Fracture | % Reduction of Area |
|---|---|---|---|---|
| U-3/4Ti | 120 | 201 | 22 | 24 |
| U-3/4Ti-0.5Hf | 120 | 216 | 25 | 47 |
| U-3/4Ti-1.0Hf | 130 | 238 | 21 | 35 |
| U-3/4Ti-1.0Hf* | 146 | 238 | 21 | 29 |
| U-3/4Ti-3.0Hf | 160 | 262 | 14 | 18 |
| U-3/4Ti-5.0Hf | 244 | 287 | 2 | — |

*Plate stock rather than extruded rod

EXAMPLE 9

Figure 5:
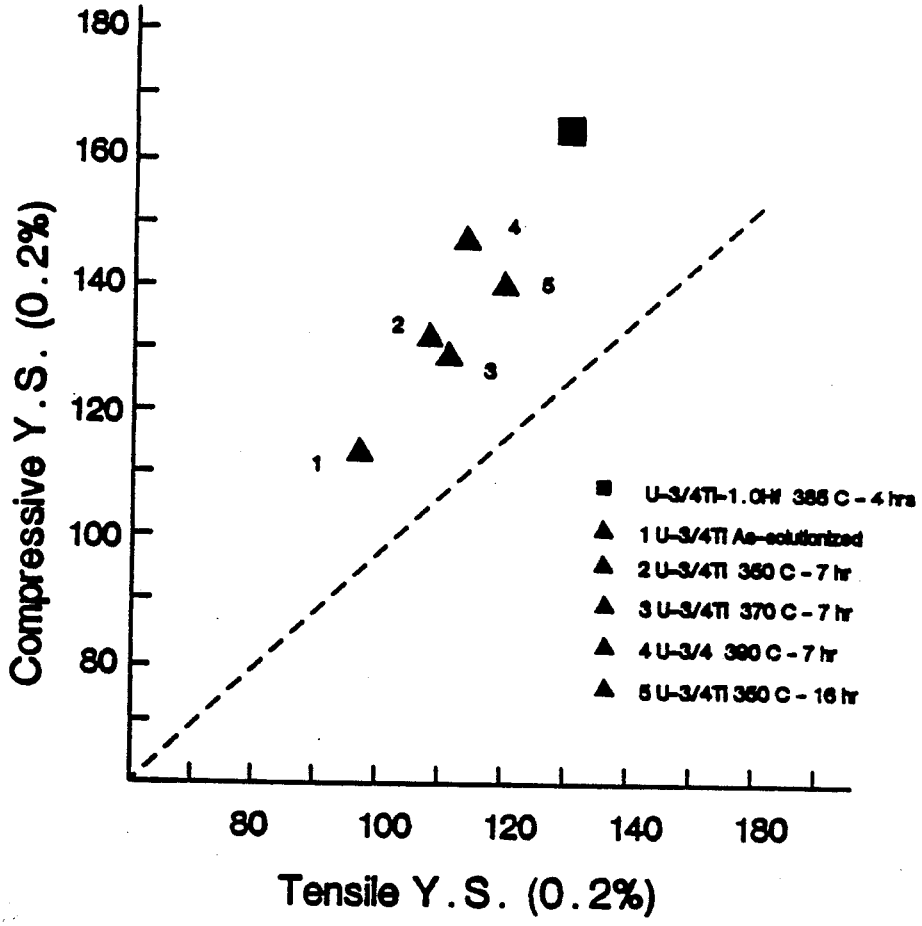
FIG. 5 is a graph showing 0.2% tensile yield strength as a function of 0.2% compressive yield strength for the alloy U-¾Ti-1.0Hf and U-¾Ti, the alloy U-¾Ti-1.0Hf having been aged at 385° C. for 4 hrs and the alloy U-¾Ti having been aged at varying aging temperatures, the data for U-¾Ti taken from Zabielski, MTL-TR-88-29, 1988.

This example illustrates that the tensile strength improvement observed from the addition of hafnium is also found in the compressive strength. Compressive samples ¼ inch in diameter and ¾ inch height were machined from the U-¾Ti-1.0Hf alloy. The heat treatment was identical to that of Example 8. FIG. 5 plots the compressive strength reported for 833 specification U-¾Ti reported by C. V. Zabielski, MTL TR 88-29, U.S. Army Materials Technology Laboratory, Watertown, Mass., (1988). The ternary U-¾Ti-1.0Hf alloy shows higher tensile and comprssive strength than those reported for the binary alloy. This compressive strength improvement arises without a loss in ductility as was described in Examples 6 and 8.

Having thus described the invention in rather full detail, it will be understood that these details need not be strictly adhered to but that various changes and modification may suggest themselves to one skilled in the art, all falling within the scope of the invention as defined by the subjoined claims.

What is claimed is:

1. A high density uranium-base ternary alloy, consisting essentially of the formula U-$Ti_xHf_y$ where x ranges from about 0.5 to 1.0 and y ranges from about 0.5 to 5.0.

2. An alloy as recited by claim 1, wherein x is about 0.75.

3. An alloy as recited by claim 1, said alloy having a microstructure substantially the same as that of a binary uranium base, titanium containing alloy.

4. An alloy as recited by claim 1, said alloy as solutionized having a yield stress of at least about 100 ksi with a minimum of 28% tensile elongation and 52% tensile reduction of area.

5. An alloy as recited by claim 1, said alloy as solutionized having a yield stress of at least about 134 ksi with a minimum of 21% tensile elongation.

6. An alloy as recited in claim 1, said alloy as solutionized being adapted to undergo precipitation hardening.

7. An alloy as recited by claim 1, said alloy upon being aged, having a yield stress of at least 146 ksi with a minimum of 21% tensile elongation.

8. An alloy as recited by claim 1, said alloy, upon being aged, having a yield stress of at least about 13 ksi with a minimum of 20% tensile elongation and 35% tensile reduction of area.

9. An alloy as recited in claim 1, said alloy, upon being aged, having a yield stress of at least about 122 ksi with a minimum of 25% tensile elongation and 47% tensile reduction of area.

10. An alloy as recited in claim 9, said alloy, upon being aged, having a compressive yield strength of at least about 164 ksi, a minimum tensile yield of 130 ksi, tensile elongation of 20%, and a tensile reduction in area of 47%.

11. An alloy as recited by claim 1, said alloy having a composition U-¾Ti-1.0Hf and having a density of at least 18 g/$cm^3$.

* * * * *

UNITED STATES PATENT AND TRADEMARK OFFICE

CERTIFICATE OF CORRECTION

PATENT NO. : 4,935,200

DATED : June 19, 1990

INVENTOR(S) : J.C. LaSalle et al.

It is certified that error appears in the above-identified patent and that said Letters Patent is hereby corrected as shown below:

Col. 6, line 14: After "uranium-base" delete "ternary".

line 35: "13 ksi" should read -- 131 ksi --.

Signed and Sealed this

Nineteenth Day of November, 1991

*Attest:*

HARRY F. MANBECK, JR.

*Attesting Officer*

*Commissioner of Patents and Trademarks*